United States Patent [19]

Morgan

[11] 4,350,274

[45] Sep. 21, 1982

[54] PORTABLE BAG FOR PET SUPPLIES

[76] Inventor: Richard T. Morgan, 6614 Annapolis La., Maple Grove, Minn. 55369

[21] Appl. No.: 208,241

[22] Filed: Nov. 19, 1980

[51] Int. Cl.[3] ..... A45C 3/00

[52] U.S. Cl. ..... 224/205; 190/51; 224/148; 220/20; 206/223

[58] Field of Search ..... 224/205, 148, 151; 206/223, 235, 541, 549, 569; 190/51; 220/23.83, 23.86, DIG. 10, 405, 408, 409, 20, 21, 22

[56] References Cited

U.S. PATENT DOCUMENTS

| | | | |
|---|---|---|---|
| 375,495 | 12/1887 | Louis | 206/549 |
| 797,667 | 8/1905 | Davis | 224/148 X |
| 3,608,770 | 9/1971 | Naimoli | 220/20 X |
| 3,705,222 | 12/1972 | Rogers et al. | 220/20 |
| 3,732,955 | 5/1973 | Carter et al. | 190/51 |

*Primary Examiner*—Steven M. Pollard
*Attorney, Agent, or Firm*—John W. Adams

[57] ABSTRACT

A complete package including a carrying bag for articles packaged therein for taking care of a household animal while traveling, the package including a flexible bag with a dish, utensils and containers confined within the bag for taking care of the animal's needs when away from home.

1 Claim, 4 Drawing Figures

PORTABLE BAG FOR PET SUPPLIES

BACKGROUND OF THE INVENTION

It has always been a problem for the owners of household animals to conveniently carry all of the supplies and utensils necessary for taking care of the animal while traveling away from home as, for example, at animal shows or when vacationing.

SUMMARY OF THE INVENTION

This is a complete package in which all of the supplies and utensils required for traveling with household animals are included therein and which includes a carrier bag made from flexible sheet material and a dish made from rigid material removably mounted in the bottom of the bag and having the same shape and outside dimensions as the insude of the bag to maintain the lower portion of the bag in the desired shape conforming to the outside dimensions of the dish, at least one container supported within the rigid dish and stabilized within the bag by the dish, the bag having a removable cover with a pocket on the outside and means on the inside for carrying a plurality of articles such as a refuse scoop and a supply of refuse bags.

DETAILED DESCRIPTION OF A PACKAGE EMBODYING THIS INVENTION

Figure 1:
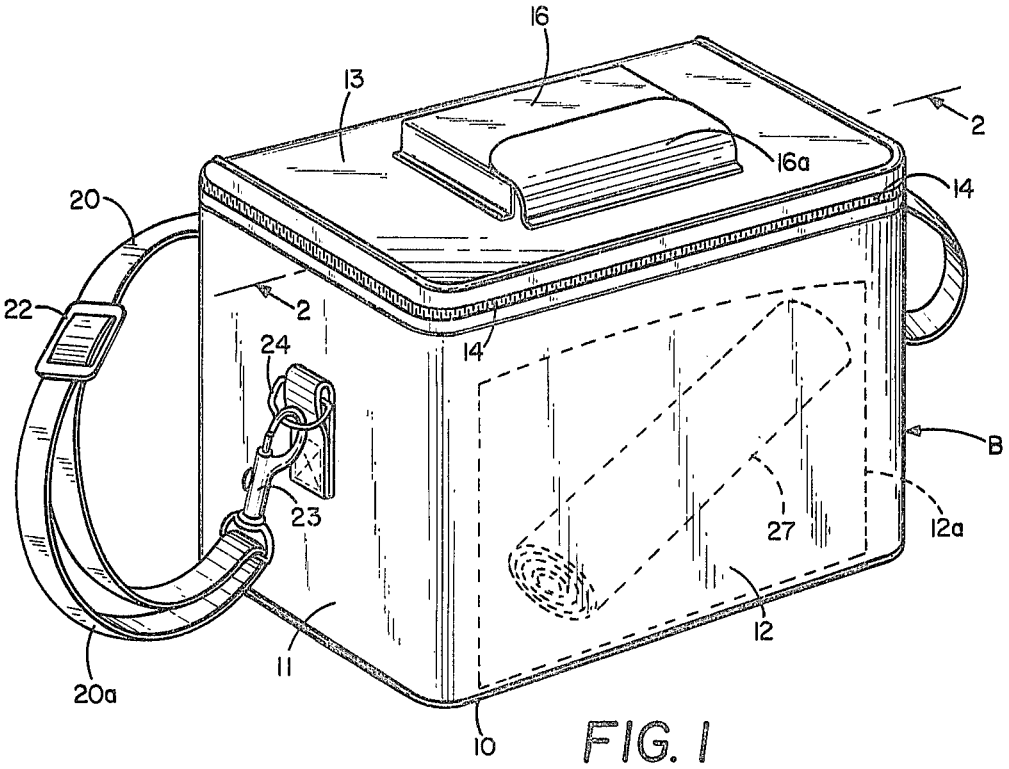
FIG. 1 is a perspective view showing the outside of a package embodying this invention.
Figure 2:
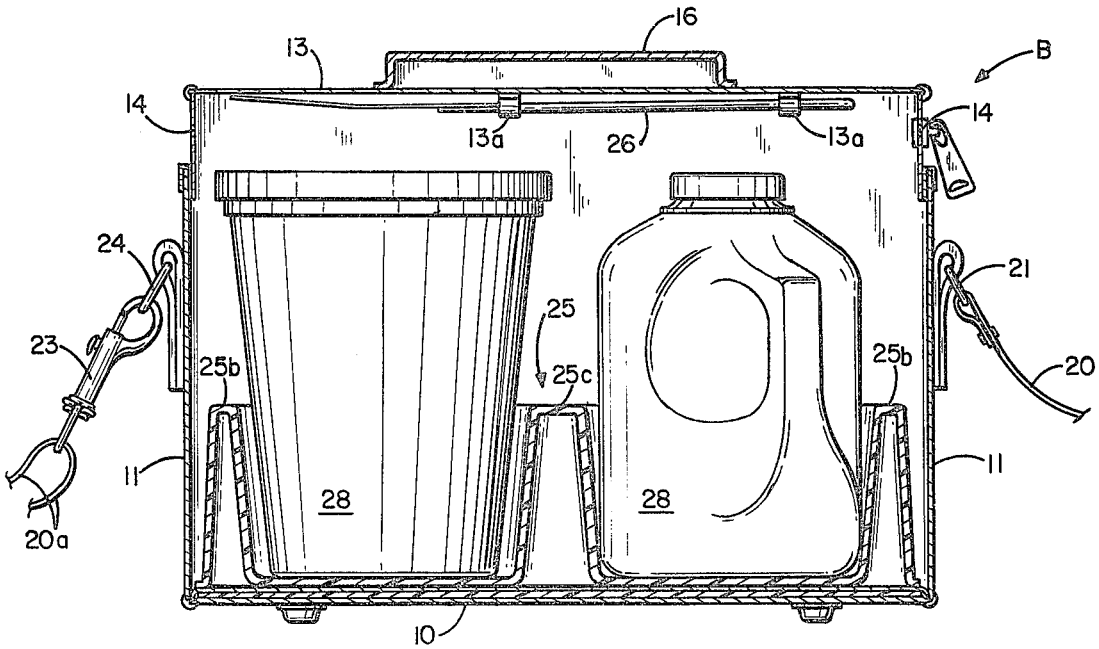
FIG. 2 is a vertical sectional view taken substantially along the line 2—2 of FIG. 1.
Figure 3:
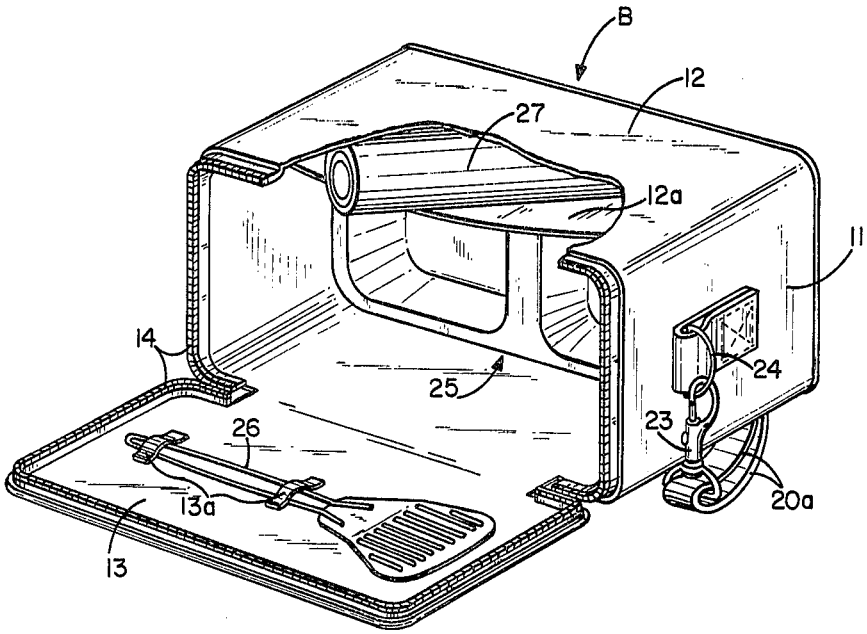
FIG. 3 is a perspective view of the bag with the cover open and the articles displayed; and, FIG. 4 is a perspective view showing the compartmented dish included in the package.
Figure 4:
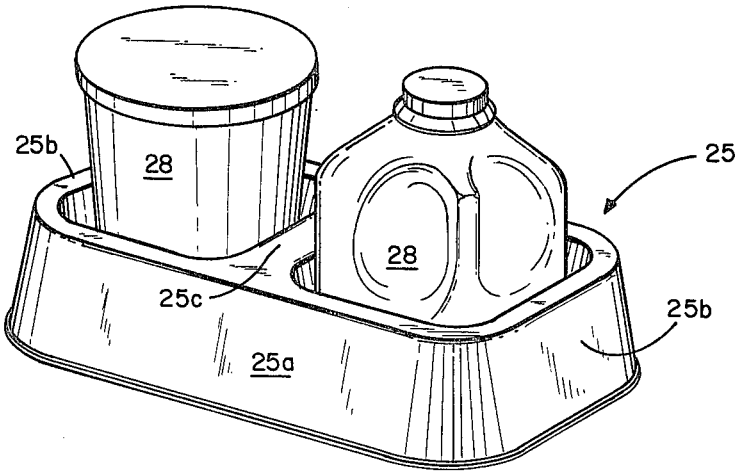

As best shown in the accompanying drawings a carrier bag B made from flexible sheet material and having a bottom 10, upwardly extending end panels 11 upwardly extending side panels 12 and a top 13 which is hinged at the top of one of the side panels 12 and has a removable closure such as the zipper 14 extending around the top of the other three panels of the bag B. A pocket 16 is provided on the outside of the cover 13 and has a suitable closure flap 16*a* provided thereon which is removably connected to the pocket 16 as by a conventional Velcro anchoring system 16*b* and 16*c*.

An adjustable strap 20 is provided with an anchoring ring 21 on one end thereof to connect the same to one end panel 11 of the bag B. An adjustment buckle 22 is connected to the other end of the strap 20 which is doubled back on itself to form an adjustment loop 20*a* which passes through a snap hook 23 which is removably received in loop 24 connected to the other end panel 11 of the bag B.

The bag B is made from suitable flexible material and has a generally rectangular shape. A compartmented rigid dish 25 is provided which has upstanding sides 25*a* and ends 25*b*. In the form shown, a divider 25*c* divides the dish into two compartments as illustrated. The dish 25 has outside dimensions which are similar to the inside dimensions and rectangular shape of the bag B and is removably received in the bottom of the bag. The compartments within the dish 25 are designed to receive one or more containers 28 for water and/or food for the animal and to limit the movement of the containers within the bag to generally keep said containers in upright stable position therewithin. A scoop 26 is removably held on the inside of the cover 13 as by a pair of loops 13*a*. A supply of bags 27 are carried in a pocket 12*a* on the inside of one of the side panels 12. The height of the containers is the same as the inside height of the bag B to provide support for the top 13 of the bag.

In the form shown both a food container and a water container are carried in the two compartments of the dish 25. The outer pocket 16 is provided for holding a limited supply of biscuits or the like for between-meal treats for the animal.

It wil be seen that a highly effective completely package has been provided for the supplies and utensils required for traveling with household animals.

What is claimed is:

1. A complete package for carrying accessories for household animals comprising, a carrier bag made from flexible sheet material and having a bottom, upstanding side and end panels, a dish made from rigid material and having lower portions of the same shape and outer dimensions as the inside of the lower portion of the bag and positioned in the bottom of the bag to maintain the desired bag shape, a carrier strap connected to the outside of the bag and being adjustable to permit the package to be carried over the shoulder or around the waist of a person using the same, a cover for the bag hinged on one edge to the top of one of the side panels of the bag and having a 3-sided zipper connecting the other edges of the top to the top of the other panels of the bag, said dish having a plurality of recessed compartments formed therein with the walls of the compartments spaced inwardly from the upstanding side portions thereof to provide space around the outside of the compartments, an upstanding rigid container in each of said compartments having side wall dimensions substantially the same as the dimensions of the insides of the compartments and extending substantially to the top of the inside of the bag to support the bag top but having diminished top portions to provide space along the top of each container, and a plurality of articles carried in the space provided along the side of the diminished top of the containers.

* * * * *